US005393202A

United States Patent [19]

Levallois

[11] Patent Number: 5,393,202

[45] Date of Patent: Feb. 28, 1995

[54] PROCESS AND DEVICE FOR OPTIMIZING THE TRANSFER BY PUMPING OF MULTIPHASE EFFLUENTS

[75] Inventor: Emile Levallois, Courbevoie, France

[73] Assignee: Institut Francais Du Petrole, Rueil Malmaison, France

[21] Appl. No.: 998,264

[22] Filed: Dec. 28, 1992

[30] Foreign Application Priority Data

Dec. 27, 1991 [FR] France ..... 91 16230
May 5, 1992 [FR] France ..... 92 05617

[51] Int. Cl.[6] ..... F04B 49/06

[52] U.S. Cl. ..... 417/19; 417/20; 417/22; 417/45; 417/53; 417/44.2

[58] Field of Search ..... 417/18, 19, 20, 22, 417/44 B, 45, 53; 60/39.463

[56] References Cited

U.S. PATENT DOCUMENTS 3,568,771 3/1971 Vincent et al. ..... 417/45
4,718,824 1/1988 Cholet et al. ..... 417/18
5,108,264 4/1992 Abdel-Rahman ..... 417/20

*Primary Examiner*—Richard A. Bertsch
*Assistant Examiner*—Roland G. McAndrews
*Attorney, Agent, or Firm*—Antonelli, Terry, Stout & Kraus

[57] ABSTRACT

Transfer by pumping of effluents containing at least one gas phase and at least one liquid phase in a transfer line connecting a source of effluents is optimized by interposing on the line, between the source and the point of designation, a multiphase pump. The rotating speed of the pump is regulated so as to adapt the pump flow rate to at least one of the following parameters: flow rate variation well, variation of the volumetric ratio GLR or pressure drop variations occurring in the line during transfer. The values of the parameters are controlled and adjusted to values comparable with the operation of the pump.

14 Claims, 3 Drawing Sheets

PROCESS AND DEVICE FOR OPTIMIZING THE TRANSFER BY PUMPING OF MULTIPHASE EFFLUENTS

FIELD OF THE INVENTION

The present invention relates to a method and to a device for optimizing the transfer by pumping of effluents containing of at least one gas phase and of at least one liquid phase, in a transfer line between a source of effluents and a point of destination by adapting the flow rate of a pump to the fluctuating conditions upstream and downstream from the pump.

These fluids or effluents may come from various sources, particularly from wellbores such as oil wells. The basic function of the pump is to apply on the fluids or effluents fed to its inlet with a certain inlet pressure or suction pressure, a compression or pressure increase sufficient to compensate for the pressure drops the effluents may undergo downstream during their transfer.

In the present text, the terms upstream and downstream relate to the pump with respect to the direction of flow of the effluents, and the term flow rate generally refers to the volume flow rate.

More specifically, the object of the method in accordance with the invention is to optimize the transfer of effluents in a transfer line by means of a multiphase pump capable of pumping the liquid phases as well as the gas phases by adapting its flow rate to the fluctuating conditions upstream, such as the flow rate variation of the source of effluents and the variation of the value of the volumetric ratio of the gas phase to the liquid phase, referred to as GLR (Gas-Liquid Ratio) in abbreviated form hereunder, which is representative of the variation of the composition of the fluid during its transfer, and conditions downstream, such as the pressure drops occurring in the line.

The method may be applied to the conveyance of a multiphase fluid from a well to a point of destination such as a treating terminal or a subsea or onshore treating platform.

Conveyance of a multiphase fluid depends on various parameters such as the variation of the flow rate of the source of effluents, or/and the flow rate variation of the multiphase pump linked to the pressure drops downstream from the pump, to the variation of the volumetric ratio at the pump suction inlet and to the suction pressure (respectively referred to as GLR (Gas and Pa hereafter). Fluctuations of these parameters will be referred to hereafter as upstream and downstream fluctuations.

With a multiphase pump, the fluctuations of the abovecited parameters, which may influence its flow rate, must be taken into account, knowing that the amount of effluents coming out of the well is to be pumped every minute.

BACKGROUND OF THE INVENTION

The devices and methods currently used for conveying fluids of the multiphase type through pipes generally combine a pump adapted for delivering a multiphase fluid consisting of at least one liquid phase and one gas phase whose volumetric ratio varies within relatively narrow limits. One is therefore obliged to use in combination a device making it possible to homogenize the fluid and thus to obtain a fluid whose volumetric ratio GLRa at the suction inlet has a value compatible with the features of the suction, which requires bulky equipments and costly investments.

French patent FR-2,642,539 mentions a known device comprising a surge drum allowing the composition fluctuations of a multiphase flow to be regulated and damped, and thus the allowable variations of the volumetric ratio of the pumped effluents may be widened within certain limits. This device or surge drum fulfils its purpose well in most cases. However, it sometimes happens that it becomes inoperative for damping the gas pockets and the oil plugs succeeding one another unforeseeably.

Moreover, pumping devices known in the prior art are not designed for taking into account the flow fluctuations of wells and the pressure drops undergone during transfers. The flow rate of the well therefore closely depends on the flow rate of the pumps used. The production capacities of wells may thus be substantially decreased.

French patent application 91/16,230 describes a method and a device for obtaining at the pump outlet a flow rate which varies like the flow rate of the well over a large variation range, by regulating the rotating speed. Determination of the rotating speed is achieved by means of parameters fluctuating upstream and downstream. These parameters may however be incompatible with the operating range of the pump; conveyance of the effluents to the terminal sometimes requires a pump outlet pressure which cannot be reached if it is merely run at the speed which can be calculated from the effective GLR value.

The operating range of the pump is defined by the parameter variation range within which the pump works properly.

SUMMARY OF THE INVENTION

The method and the device in accordance with the invention make it possible to obtain, at the pump outlet, a flow rate which follows the variation of flow of the well by controlling the parameter values so that they correspond to the operating range of the pump, in order to have a rotating speed determined from these parameters compatible with the characteristics of the pump and the conditions necessary for the transfer.

The method in accordance with the invention allows to optimize the transfer of effluents comprising of at least one liquid phase and one gas phase in a transfer line connecting a source of effluents whose weight flow or volume flow rate exhibits variations to a point of destination, by taking into account the variations of the gas-liquid volumetric ratio (GLRa) at the pump inlet, as well as downstream pressure drops during the transfer of the fluid, and thus to remedy the drawbacks of well-known devices and methods, whatever the downstream and upstream fluctuations may be.

The method is characterized in that a multiphase pump is interposed on the line between the source of effluents and the point of destination, and in that the rotating speed of the multiphase pump is regulated so as to adapt its flow rate to at least one of said variations.

According to one of the features of the invention, with the pump applying a compression ($\Delta P$) to the effluents, the rotating speed (N) of the pump is, for example, determined by combining four magnitudes or parameters which are the inlet pressure (Pa) at the inlet of the multiphase pump, the volumetric ratio at the suction inlet of the pump (GLRa), the compression (ΔP) applied by the pump and the overall flow rate (Qt) of the effluents produced by the source.

With the pump working properly within a given range of parameter variations, any parameter whose value is outside said range is allocated a limiting value allowing an operating speed compatible with the possible variation range of the speed of said pump to be determined.

The value of the rotating speed may for example be obtained by achieving an interpolation from families grouping particular values of these four parameters for which the rotating speed (N) suited to the pump is known.

The volumetric ratio at the suction inlet of the pump (GLRa) may be brought down, if necessary, to a value within a parameter variation range for which the pump works properly, by adding a certain amount of liquid. The amount of liquid to be added to the effluents is determined as a function of the maximum value of the gas-liquid volumetric ratio of the effluents which can be treated by the pump.

The method comprises, for example, using a tank or drum crossed through by a tube pierced with a plurality of openings and interposed between the source of effluents and the multiphase pump, which allows said ratio (GLRa) to be determined from the height h of the portion of pierced tube lying in the gas, by taking into account the distribution of the openings along this tube.

The method in accordance with the invention may further comprise determining the compression (ΔP) by adding the successive variations of the delivery pressure to a value determined previously.

In case a device fitted with a tank and a pierced tube, as mentioned above, is used, the value of the well flow rate may be determined through an iterative process by adding to a previously determined value a variation of the flow rate of the source of effluents.

This method may notably be applied to the transfer of a multiphase fluid between a source of effluents, such as a well, and a point of reception, such as a treating platform.

By means of this regulation of the pump speed, by taking into account upstream and downstream fluctuations such as they are defined, the method in accordance with the invention makes it possible to remove to a large extent anything likely to slow down the free transfer of the effluents towards their point of destination.

The invention also relates to a device for implementing the method, comprising in combination means for determining the volumetric ratio (GLRa), measuring means for determining the inlet pressure (Pa), means for measuring the delivery pressure Pref, and a programmed processing unit for storing these values and parameter values determined at the start (ratio GLR, volume Vo, etc.) and calculating the new value of the rotating speed of the pump, so as to adapt the flow rate of the pump to the variations of at least one of the following three parameters: flow rate of the effluents, value of said (GLRa) or pressure drops downstream from the pump.

The means for determining said volumetric ratio (GLRa) may be, for example, a tank provided with a tube pierced with a plurality of openings and interposed between the source of effluents and the pump.

The device may also comprise means for measuring the temperature T prevailing in the tank.

The programmed processing unit can store a set of limiting values. The limiting values define the range within which the pump works properly.

The device may for example comprise at least one secondary pipe for injecting a liquid phase, as well as secondary means necessary to control the amount of liquid added.

The device may be positioned on a structure arranged between a well head and a point of reception such as a treating platform, and the structure may be floating or underwater.

BRIEF DESCRIPTION OF THE DRAWINGS

Other features and advantages of the method in accordance with the invention will be clear from reading the following description of embodiments given by way of non limitative example, with reference to the accompanying drawings in which.

DESCRIPTION OF THE PREFERRED EMBODIMENTS

Figure 1:
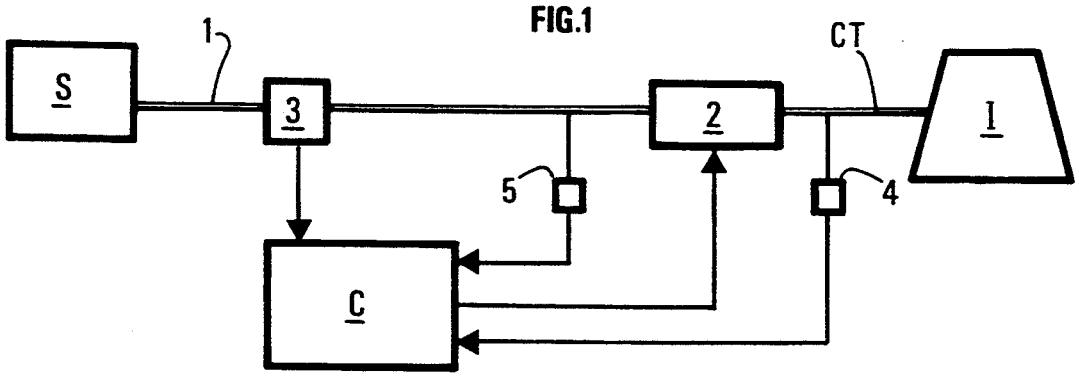
FIG. 1 diagrammatically shows one embodiment of the device in accordance with the invention.

The method in accordance with the invention is implemented for example by a first embodiment described in FIG. 1.

The method in accordance with the invention allows the transfer of effluents comprising at least one liquid phase and at least one gas phase coming from a source such as a well head S, for example, to a receiving installation I, to be optimized. The effluents are conveyed from source S through a pipe 1 to the suction inlet of a multiphase pump 2. A device 3 suited to determine the value of the volumetric ratio GLRa at the suction inlet, which is likely to vary, is interposed on this pipe, near the inlet of pump 2.

Two pressure sensors 4, 5 are respectively arranged at the outlet and at the inlet of pump 2 to measure the outlet or delivery pressure Pref and the inlet or suction pressure Pa. The effluents coming from pump 2 are conveyed through a pipe CT to installation I, which is, for example, an onshore or offshore platform, possibly underwater, and provided with the usual equipment for treating multiphase effluents.

Regulation of the running of pump 2 is achieved by means of a computer C from the data received from device 3 and sensors 4, 5. This computer may be, for example, a microcomputer equipped with an acquisition card of a well-known type and programmed for performing the stages of the method which will be defined hereafter.

The objective being to obtain a value of the pump flow rate which follows the fluctuations or variations upstream or downstream from the pump, it appeared that this could be reached by varying the speed of the pump as a function of the result of the combination of a certain number of known parameters, and by achieving successive cycles comprising the following stages:

Stage 1

The value of ratio GLRa is first determined by means of a device 3 of a well-known type for measuring the volumetric ratio and located close to the inlet of the pump, such as described in patent FR-2,647,549. The device described in FIG. 2 may also be used therefore according to specific procedures which will be defined below.

Stage 2

Then the value of compression ΔP applied by the pump to the multiphase fluid is determined by measuring, by means of pressure sensor 4, the value of the delivery pressure P'ref of the pump and the value of the suction pressure or inlet pressure Pa by means of sensor 5 located on line 1 at the inlet of the pump, then by calculating the difference between the two values.

It may also be proceeded by iterations, by adding to the value of the compression $\Delta P_p$ determined previously the successive variations of the delivery pressure (P'ref −Pref) obtained by comparing the successive measurements of pressure sensor 4 at the outlet of pump 2:

$$\Delta P = \Delta P_p + (P'ref - Pref)$$

It might also be proceeded by taking into account the compression value (ΔPI) considered initially.

Stage 3

The value of the overall flow rate Qt of the effluents from source S is determined through an iterative process by adding to a value Q determined previously a variation of the overall flow rate Qp obtained by applying Mariotte's law to the variation of volume of gas and of pressure, in a given space contained between the source of effluents S and pump 2, in this case, pipe 1.

To that effect, the characteristic parameters measured or known initially must be known, such as the value of the volumetric ratio GLR of the well measured at the beginning of its exploitation, and the value of the volume Vo occupied by the gas in the space considered.

Mariotte's law expresses the fact that, in the volume Vo considered, in this case pipe 1, the increase in the flow rate during the time dt multiplied by the pressure P prevailing in space Vo equals volume Vo multiplied by the pressure increase dP during time dt. The pressure is taken as equal to the value of the pressure at the suction inlet, and similarly the pressure increase relates to the pressure increase at the inlet of the pump.

Thus, when the flow rate of the well varies, and when the flow rate of the pump is not adapted to this variation, the result thereof is a pressure increase in the pipe. The flow rate variation of the effluents in pipe 1 is equal to the difference of the variations of the overall flow rate Qp of the well and of the overall flow rate Qa of the pump.

The variation Qp of the overall flow rate of the well results from the variation of the gas flow and from the variation of the liquid flow of the source of effluents. The respective terms of said variations of the gas or liquid flows are obtained, as it is known by specialists, by multiplying the variation of the overall flow rate Qp respectively by the factors GLR/(1+GLR) and 1/(1+GLR).

Figure 4:
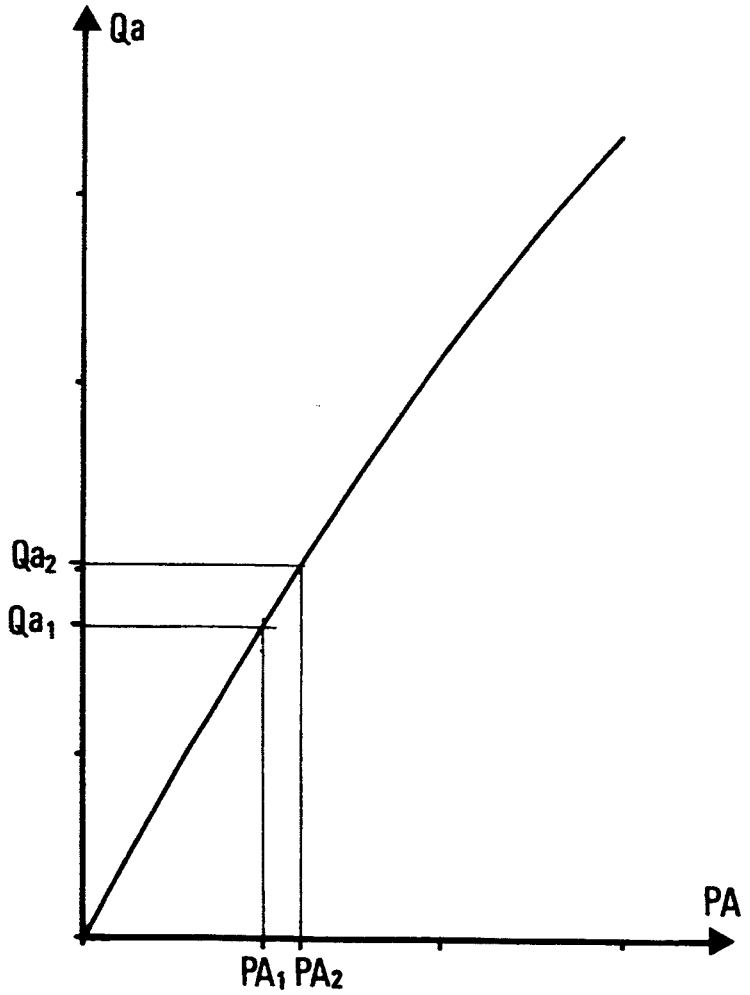
FIG. 4 shows a curve illustrating the relation between the value of the pump flow rate and the value of the suction pressure.

The variation of the overall pump flow rate Qa can be obtained from the curve shown in FIG. 4.

The curve shown in this figure has been obtained during previous tests, by using a multiphase type pump such as that described in patent application FR-90/09,607 cited above.

The value of the overall flow rate Qa of the pump has been plotted as a function of the suction or inlet pressure and as a function of the GLRa for a given rotating speed and overpressure value ΔP.

The curve has been determined with models of the second degree with a linear interpolation between two curves of a single sub-family, for example ΔP constant and GLRa variable.

For a multiphase pump of another type, analogous families of curves would first be similarly plotted.

The term which must be taken into account is the variation of the gas flow rate of the pump which is obtained from the overall flow rate variation (Qa2−-Qa1) multiplied by the factor representative of the gaseous amount, that is GLRa/(1+GLRa).

Application of Mariotte's law to the variation of the gaseous volume in pipe 1 makes it possible to deduce the variation Qp of the overall well flow rate as a function of the inlet pressure Pa measured by means of pressure sensor 5, of the variation of the inlet pressure Pa during a time t, of the volume Vo occupied by the gas in pipe V1, and of the gas flow variation during the time dt.

The value of the overall flow rate Qt of the effluents produced by the wells then equals Qt=Q+Qp with Q which is equal to the value, which has been previously found, of the flow rate of the effluents produced by the well.

By means of the three values GLRa, Qt and ΔP and of the measurement of the inlet pressure Pa, it is possible to deduce, with a programmed computer C, the new value of the rotating speed which the pump should have so as to adapt the delivery of the multiphase pump to at least one of said variations.

To that effect, a program is used, which utilizes a quadratic method allowing the speed of the pump to be calculated from the combination of the four parameters.

The programme is achieved as follows:

A series of measurements is performed by running a multiphase pump such as that described in French patent application FR-90/09,607 for example.

From these measurements, families of curves characteristic of pump hydraulics are plotted, which allow families of discrete values linking together the five parameters Pa, ΔP, GLRa, Qt and N, the value of the rotating speed of the pump, to be determined. These values are assembled in a table.

From these discrete values, an interpolation programme is constructed, which brings into play a quadratic method allowing the value of the fifth parameter, which is here the rotating speed of the pump, to be calculated from these known value families of the four parameters.

The method described above is particularly well suited when the parameter values from which the rotating speed of the pump is determined vary within a range for which the pump works properly.

The program also makes it possible to control the values measured for the four parameters and to allocate, if need be, to the values located outside the range, a limiting value allowing an operating speed of the pump compatible with the technical data of the pump to be determined.

The range within which the pump works properly (or operating range) is defined by all the values which the parameters GLRa, Qt, ΔP, Pa and N can take at the same time.

These values have been previously determined during tests during which the values GLRa, Qt, Pa and N for which the pump imparts the effluents enough pressure to transfer them over a certain distance have been determined.

Control and correction of the parameter values, when they are outside the range limits, is for example achieved as follows:

- the four parameters measured are compared to the values defining the operating range of the pump. Each parameter located outside the operating range is allocated the closest limiting value in the operating range,
- the new values obtained are controlled again until the values of the four parameters as a whole correspond to a set contained in the operating range of the pump.

The fifth parameter, that is here the rotating speed, is determined from the parameter values controlled as described above, by means of the interpolation programme defined above.

Microcomputer C delivers a signal which influences the rotating speed of the motor driving the pump so as to correct it if need be. The motor is for example an electric motor of a well-known type whose speed depends on the frequency of the electrical signal applied to it. In this case, computer C is adapted for changing the frequency of the signal controlling the motor as a function of the speed correction to be made.

The fluid is then transferred from pump 2 to an installation I for treating the effluents by means of line section CT. Installation I may be a treating platform located onshore or offshore, on the water or underwater (positioned below the surface or on the seabed), equipped with the usual devices for treating multiphase fluids.

Simulations have been performed for a multiphase oil effluent. They show that the regulation precision is higher than 1%.

The processing unit thus makes it possible to determine especially the amount of liquid to be added to the effluent so as to bring the value of GLRa down to a value within the operating range.

The amount of liquid to be added is calculated as follows: as the measured value GLRa and the closest GLR limiting value within the operating range defined above are known, the flow rate of the liquid necessary to bring value GLRa down to a value that can be treated by the pump is deduced. The microcomputer delivers a signal which acts on a valve so as to let pass an amount of liquid bringing the measured value GLRa down to a value GLR compatible with the running of the pump.

Figure 2:
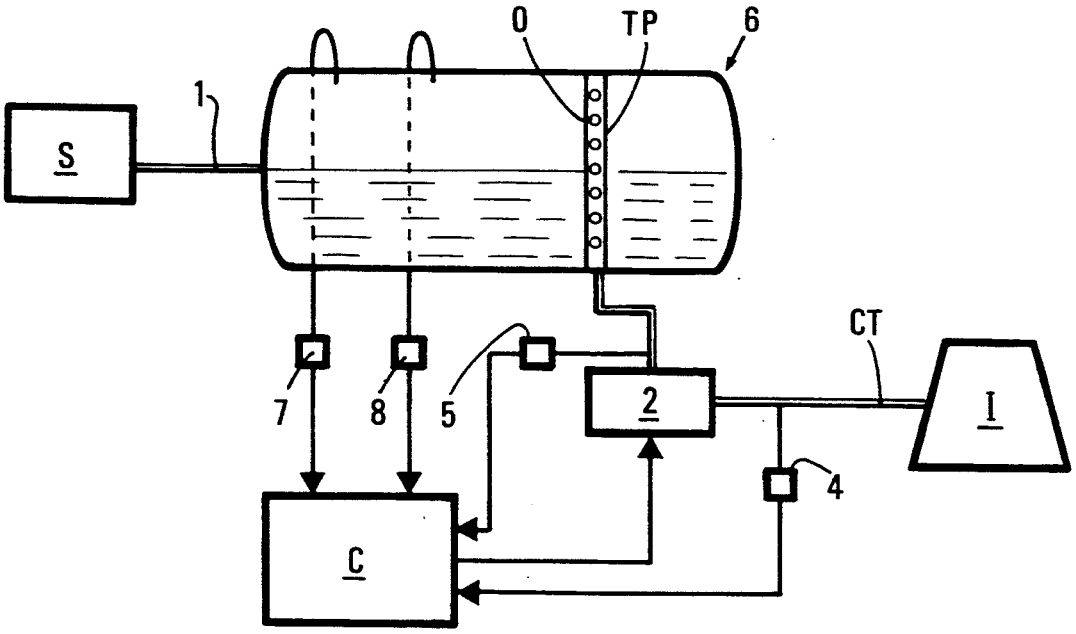
FIG. 2 shows another embodiment in which the means for determining the volumetric ratio GLRa comprise a vessel such as a regulating drum provided with a tube pierced with a plurality of openings.

According to a preferred embodiment shown in FIG. 2, which has already been described in patent FR-2,642,539 cited above, device 3 comprises a surge drum, or tank or vessel 6 receiving the effluents coming from source S. The effluents drawn by pump 2 are taken from tank 6 by means of a sample tube TP crossing the vessel and fitted with openings O distributed over at least part of its length. A pressure sensor 8 measures the pressure prevailing in tank 6 and a temperature sensor 7 allows the value of the temperature T prevailing in tank 6 to be known at any time. All these data are transmitted to the acquisition card of computer C.

Stage 1

The value of the volumetric ratio GLRa is determined by means of set parameters such as the overall height of tube H, the values of the specific masses of the liquid and the gas, the value of the piercing coefficient Co of the tube, the characteristic function of the piercing of the tube equipping the regulating tank f(h,H) and of the measure of the height h of the section of the pierced tube TP lying in the gas, of the measure of the temperature T and of the pressure Pbt prevailing in the regulating tank and of the suction pressure Pa at the pump inlet. Physical phenomena occurring between the outlet of the drum and the pump suction, notably pressure drops and possible adiabatic expansions of the gas, should also be taken into account. Another way to proceed consists of measuring the level of the liquid present in the drum.

Stage 2

To obtain the value of the compression P corresponding to the downstream pressure drops, the respective values of the delivery pressure P'ref and of the suction pressure Pa, measured respectively by sensors 4, 5, are subtracted.

Successive incrementation stages may also be performed by taking into account the presence of surge drum 6 and by measuring the pressure Pbt prevailing in the surge drum by means of pressure sensor 8. The value of the nominal pressure Pbtc that is fixed must also be known.

In case the value of the compression ΔPI determined previously is taken into account, and knowing Pref, Pbtc, Po and taking into account the measurements of Pa, Pbt and P'ref, the new value of ΔP which takes into account the pressure drop variations downstream from the pump is deduced.

$$\Delta P = \Delta PI + (P'ref - Pref) + (Pbt - Pa) - (Pbtc - Po)$$

A curve similar to the curve shown in FIG. 4 has been plotted. The difference between the two curves results from the correction factor due to the adiabatic expansion.

Stage 3

The value of the overall flow rate Qt of the effluents coming from the source is determined as in stage 3 defined above, with reference to FIG. 1, but by taking into account the presence of surge drum 6. A correction coefficient linked to the adiabatic expansion between surge drum 6 and the pump inlet is introduced. This coefficient only applies to the terms representative of the gas volume variation in the line and equals $(Pa/Pbt)^{1/\alpha}$ where Pbt is the pressure prevailing in the regulating drum, measured by means of sensor 8, and $\alpha$ is a coefficient equal to C−c (where C and c are respectively the values of the specific heats respectively at constant pressure and volume).

The new value of the rotating speed which the pump should have in order to adapt the flow rate of the multiphase pump to at least one of the variations is obtained, as previously, with reference to FIG. 1.

Figure 3:
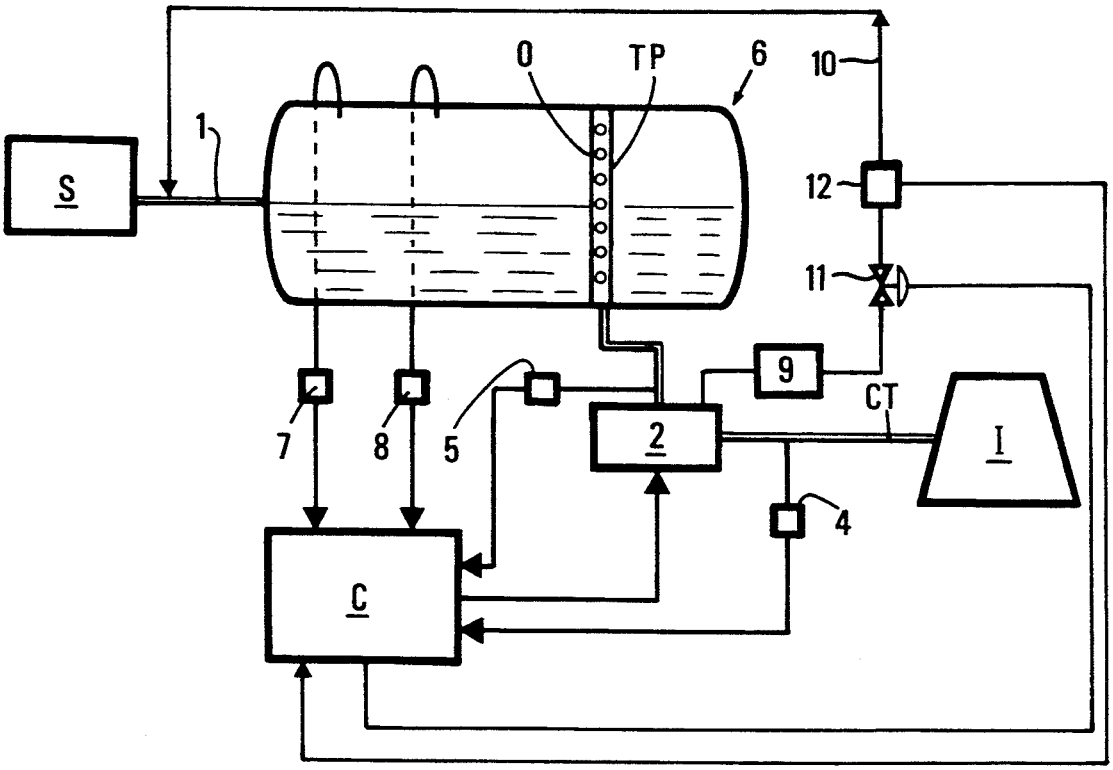
FIG. 3 shows the device of FIG. 2 associated with means for recycling the liquid.

FIG. 3 shows another embodiment in which the pumped effluent can be treated in a separator 9 recycling a certain amount of liquid in a surge drum 6 through a recycling line 10. Recycling line 10 is equipped with a remote-controlled and servo-controlled valve 11 providing passage for the liquid to be added, and with means 12 for measuring the flow rate, which allow the amount of liquid added to be controlled so as to bring the value of ratio GLRa down to a value that can be treated by the pump.

Implementation of the method comprises stages 1 and 2 described in connection with FIG. 2. Stage 3 above is changed in that, while controlling the parameter values, the value of the volumetric ratio GLRa is brought down to the closest value which can be treated by the pump by adding a certain amount of liquid to the fluid. The amount of liquid to be added having been determined as described above, microcomputer C sends out a signal allowing progressive opening of the valve until the flow rate of liquid to be added reaches a value such that the measured value of the volumetric ratio GLRa is equal to the value allowing the pump to treat the effluents. The value of GLRa may be controlled in two ways. The value of the flow rate of liquid flowing through the recycling line can for example be measured. When the value is reached, the valve is kept in its position. The amount of liquid to be added may also be proportioned by controlling the value of the volumetric ratio GLRa.

Figure 5:
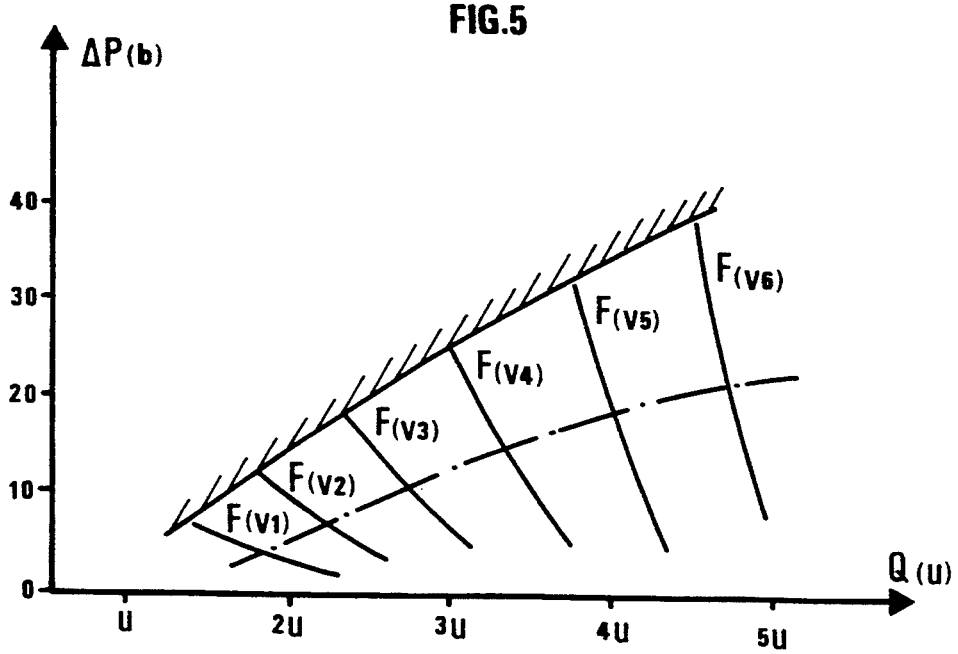
FIG. 5 shows a family of curves plotted at constant suction pressure and GLRa, linking the value of the compression provided by a pump to the flow rate of the effluents crossing it, for a given rotating speed.

FIG. 5 shows a family of curves F(V1) . . . F(V6) obtained during tests achieved with a multiphase pump. The family of curves has been plotted for constant suction pressure values Pa and constant volumetric ratio values GLRa, and it shows the variations as a function of the overall pump flow rate and as a function of the compression value ΔP, for several determined velocities V1, V2 . . . V6.

These curves make it possible to determine for example the discrete values assembled in the table and used as a basis for determining the interpolation programme allowing a fifth parameter to be calculated from four parameters.

The discrete values assembled in the table are deduced from several families of curves obtained for different suction pressure values Pa and values GLRa, and the relation connecting the five parameters is established from these values.

It would also be possible to start from the technical specifications provided by the pump manufacturer and set up a table of discrete values including the five parameters: Pa, GLRa, ΔP, Qt and the rotating speed N.

Of course, various changes and/or additions may be provided by the man skilled in the art to the process and to the device which have been described by way of non limitative example, without departing from the scope of the invention.

I claim:

1. A device for optimizing the transfer of effluents comprising at least one gas phase and at least one liquid phase by pumping, which device comprises, in combination, means for determining the volumetric ratio at the suction inlet of the pump (GLRa), means for measuring the inlet pressure (Pa) at the inlet of the multiphase pump, means for measuring the delivery pressure (Pref) of the pump, and a programmed processing unit (C) for storing values of GLRa, Pa and Pref and parameter values determined from the start of the transfer, and calculating a new value of the rotating speed (N) of the pump so as to adapt the flow rate of the pump to the variations of at least one of the following three parameters: the effluents flow rate, the value of the volumetric ratio (GLRa), or pressure drops downstream from the pump.

2. A device as claimed in claim 1, wherein the means for determining said volumetric ratio (GLRa) consist of a tank provided with a pierced tube with a plurality of openings, and means for measuring the temperature prevailing in said tank.

3. A device as claimed in claim 1, wherein the programmed processing unit (C) comprises means for storing the whole of said limiting values.

4. A device as claimed in claim 1, comprising at least one secondary pipe for injecting a liquid phase, as well as secondary means necessary to control the amount of liquid added.

5. A device as claimed in claim 1, wherein the device is positioned on a structure arranged between a well head and a point of designation, and said structure is a floating structure.

6. A device as claimed in claim 1, wherein the device is positioned on a structure arranged between a well head and a point of designation, and said structure is an underwater structure.

7. A method for optimizing the transfer of effluents comprising at least one gas phase and at least one liquid phase in a transfer line connecting a source of effluents of variable flow rate to a point of designation by pumping, allowing for variations of the volumetric ratio of the gas phase to the liquid phase, as well as pressure drop variations in the line during transfer of the liquid, said method comprising interposing on said line, between the source of effluents and the point of designation, a multiphase pump and regulating the rotating speed of said multiphase pump to adapt the flow rate of said multiphase pump to at least one of said variations; the pump applying a compression (ΔP) to the effluents and the rotating speed (N) of the pump being determined by the following parameters: the inlet pressure (Pa) at the inlet of the multiphase pump, the volumetric ratio at the suction inlet of the pump (GLRa), the compression (ΔP) applied by the pump and the overall flow rate (Qt) of the effluents produced by said source.

8. A method as claimed in claim 7, wherein, the pump working properly within a given range of parameters any parameter whose value is outside said range being allocated a limiting value allowing an operating speed compatible with possible speed variation range of said pump to be determined.

9. A method as claimed in any one of claims 7 or 8, wherein the value of the rotating speed is obtained by interpolation of families based on particular values of said parameters for which the rotating speed (N) suited to said pump is known.

10. A method as claimed in claim 7, wherein the volumetric ratio (GLRa) at the suction inlet of the pump is brought down to a value within a variation range of a parameter for which the pump works properly, by adding a certain amount of liquid, the amount of liquid to be added to the effluents being determined as a function of the maximum value of the gas-liquid volumetric ratio of the effluents which can be treated by the pump.

11. A method as claimed in claim 7, wherein the compression (ΔP) is determined through an iterative process by adding to a value determined previously the successive variations of the delivery pressure.

12. A method as claimed in claim 7, wherein the source of effluents is a oil well, the method further comprising transferring a multiphase fluid containing a gas phase and a liquid phase between the well and the point of designation of the multiphase fluid.

13. A method as claimed in claim 7, wherein said ratio (GLRa) is determined by interposing between the source of effluents and the multiphase pump a tank crossed through by a tube pierced with a plurality of openings, by measuring a height h of a portion of the pierced tube lying in a gas and by taking into account distribution of the openings in the pierced tube.

14. A method as claimed in claim 13, wherein the value of the effluent flow rate is determined through an iterative process.

* * * * *